US010497271B2

(12) United States Patent
Schwartz et al.

(10) Patent No.: US 10,497,271 B2
(45) Date of Patent: Dec. 3, 2019

(54) RUNWAY EXITING SYSTEMS AND METHODS FOR AIRCRAFT

(71) Applicant: THE BOEING COMPANY, Chicago, IL (US)

(72) Inventors: Samantha A. Schwartz, Castle Pines, CO (US); Jason W. Clark, Evergreen, CO (US); Jeffrey L. Williams, Parker, CO (US); Katie M. Reid, Englewood, CO (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 15/375,230

(22) Filed: Dec. 12, 2016

(65) Prior Publication Data

US 2018/0165975 A1 Jun. 14, 2018

(51) Int. Cl.

| | |
|---|---|
| ***G08B 21/00*** | (2006.01) |
| ***G08G 5/06*** | (2006.01) |
| ***G08G 5/02*** | (2006.01) |

(52) U.S. Cl.

CPC ..... *G08G 5/065* (2013.01); *G08G 5/02* (2013.01); *G08G 5/025* (2013.01)

(58) Field of Classification Search

CPC .. G08G 5/0021; G08G 5/0013; G08G 5/0078; G08G 5/065; G08G 5/0008; G08G 5/045; G08G 5/0052; G08G 5/0091; G08G 5/025; G08G 5/04; G08G 1/123; G08G 5/0026; G08G 5/0034; G08G 5/0039; G08G 5/006; G08G 5/0086

See application file for complete search history.

(56) References Cited

U.S. PATENT DOCUMENTS

| | | | | |
|---|---|---|---|---|
| 3,114,892 A * | 12/1963 | Finch | B64F 1/20 | 340/953 |
| 3,706,969 A * | 12/1972 | Paredes | G08G 5/0013 | 340/989 |
| 5,374,932 A * | 12/1994 | Wyschogrod | G01S 13/91 | 342/29 |
| 5,375,058 A * | 12/1994 | Bass | G05D 1/0083 | 342/450 |
| 5,519,618 A * | 5/1996 | Kastner | G01S 13/91 | 701/120 |
| 5,968,106 A * | 10/1999 | DeVlieg | B60T 7/22 | 244/183 |

(Continued)

OTHER PUBLICATIONS

Extended European Search Report for EP 17203856.2-1203, dated May 2, 2018.

*Primary Examiner* — Joseph H Feild
*Assistant Examiner* — Rufus C Point
(74) *Attorney, Agent, or Firm* — Joseph M. Butscher; The Small Patent Law Group, LLC

(57) ABSTRACT

A runway exiting system is configured to determine a suitable exit off of a runway for an aircraft. The runway exiting system includes a housing, and one or more processors within the housing that are configured to determine a current position of the aircraft on the runway, determine a current rate of deceleration of the aircraft on the runway, and determine the suitable exit off of the runway for the aircraft based, at least in part, on the current position of the aircraft on the runway and the current rate of deceleration of the aircraft on the runway.

20 Claims, 3 Drawing Sheets

(56) References Cited

U.S. PATENT DOCUMENTS 6,847,866 B2 * 1/2005 Gaier ..... G01C 23/00 244/75.1
7,014,146 B2 * 3/2006 Villaume ..... G05D 1/0083 244/111
7,589,644 B2 * 9/2009 Meunier ..... G08G 5/0026 340/945
7,818,100 B2 * 10/2010 Goodman ..... G05D 1/0083 244/111
8,209,072 B2 * 6/2012 Villaume ..... G08G 5/0021 340/947
8,352,103 B2 * 1/2013 Lewis ..... B64F 1/00 244/114 R
8,583,352 B2 * 11/2013 Klooster ..... G08G 5/025 701/120
8,774,989 B1 * 7/2014 Bush ..... B64D 43/02 340/952
9,014,881 B2 * 4/2015 DeGagne ..... G08G 5/0021 701/16
9,098,996 B2 * 8/2015 Barraci ..... G08G 5/0013
9,224,302 B1 * 12/2015 Young ..... G08G 5/0039
2005/0006524 A1 * 1/2005 Villaume ..... G05D 1/0083 244/111
2007/0208466 A1 * 9/2007 Meunier ..... B64C 25/426 701/16
2008/0249675 A1 * 10/2008 Goodman ..... B64C 25/426 701/16
2010/0042267 A1 * 2/2010 Goodman ..... B64D 31/04 701/3
2010/0283636 A1 * 11/2010 Clark ..... G01C 23/00 340/971
2010/0299005 A1 11/2010 Hugues
2011/0071750 A1 * 3/2011 Giovino ..... G08G 5/06 701/120
2011/0098872 A1 * 4/2011 Lewis ..... B64F 1/00 701/16
2011/0108665 A1 * 5/2011 Abrial ..... F02C 9/00 244/110 B
2012/0158220 A1 * 6/2012 Accardo ..... G05D 1/0646 701/15
2013/0261855 A1 * 10/2013 DeGagne ..... G08G 5/0021 701/16
2015/0084793 A1 * 3/2015 Khatwa ..... B64D 45/00 340/969
2016/0272344 A1 * 9/2016 Degagne ..... B64F 1/20
2017/0083206 A1 * 3/2017 He ..... G06F 3/04817

* cited by examiner

RUNWAY EXITING SYSTEMS AND METHODS FOR AIRCRAFT

FIELD OF EMBODIMENTS OF THE DISCLOSURE

Embodiments of the present disclosure generally relate to aircraft, and, more particularly, to runway exiting systems and methods for aircraft.

BACKGROUND OF THE DISCLOSURE

Commercial aircraft are used to transport passengers between locations. During a typical day, numerous commercial aircraft may take off from and land at a particular airport. After an aircraft lands on a runway, a pilot maneuvers the aircraft onto a taxiway via one of multiple exits from the runway.

After an aircraft touches down on a runway, a pilot applies brakes of the aircraft so that the aircraft decelerates on the runway. A pilot then visually searches for a safe exit point from the runway. In low visibility situations, a pilot may have difficulty finding an appropriate exit from the runway. The pilot may maneuver past an unseen exit from the runway. As such, the aircraft may remain on the runway, which may prevent other aircraft from landing on the occupied runway.

Often, a pilot may decelerate the aircraft to a relatively low speed so that an appropriate exit is not missed. However, because the aircraft is traveling at a slower speed, the aircraft remains on the runway for a longer period of time. As such, other aircraft may be prevented from landing on the runway due to the pilot of the low speed aircraft on the runway trying to find an exit.

In general, pilots currently need to judge if they can safely exit an aircraft onto a nearby taxiway via one of multiple exits from the runway. Particularly in low visibility situations, a pilot may be overly cautious and opt for a taxiway further down the runway. As such, the aircraft burns more fuel, taxi time increases, and another aircraft waiting to land may need to circle the airport due to the runway being occupied longer than expected.

Whether the aircraft misses a suitable exit point from a runway, or is moving relatively slow on the runway searching for the suitable exit, arrival time at a gate is extended. As such, arrival at the gate may be later than expected, which generally disappoints passengers onboard the aircraft. Further, individuals typically wait at the particular gate for the aircraft for a subsequent flight. The departure time for such individuals may also be delayed, due to the pilot of the aircraft searching for an appropriate exit from the runway.

An aircraft remaining on a runway poses safety concerns, in that other aircraft may be prevented from landing, or may land and generally be relatively close to the initial aircraft on the runway. Further, aircraft on the runway may increase customer dissatisfaction in that both arrival and departures times may be delayed.

SUMMARY OF THE DISCLOSURE

A need exists for a system and method of efficiently and safely directing pilots to exit a runway. A need exists for reducing flight arrival and departure times at an airport. A need exists for improving flight turnaround at an airport.

With those needs in mind, certain embodiments of the present disclosure provide a runway exiting system that is configured to determine a suitable exit off of a runway for an aircraft. The runway exiting system includes a housing, and one or more processors within the housing that are configured to determine a current position of the aircraft on the runway, determine a current rate of deceleration of the aircraft on the runway, and determine the suitable exit off of the runway for the aircraft based, at least in part, on the current position of the aircraft on the runway and the current rate of deceleration of the aircraft on the runway.

The processor(s) may include a position determination unit that is configured to determine the current position of the aircraft and output one or more position signals indicative of the current position of the aircraft. The processor(s) may also include a deceleration determination unit that is configured to determine the current deceleration rate of the aircraft by analyzing the position signal(s) over a predetermined period of time.

In at least one embodiment, the runway exiting system includes a runway map database that stores a digital map of the runway. The runway map database may be contained within the housing.

The processor(s) may include a runway position correlation unit that is configured to correlate a current position of the aircraft with respect to a digital map that is indicative of the runway. The processor(s) may include an exit determination unit that is configured to determine the suitable exit off of the runway for the aircraft based, at least in part, on the current position of the aircraft on the runway and the current rate of deceleration of the aircraft on the runway.

In at least one embodiment, a display is coupled to the housing. The display is configured to show aircraft indicia superimposed on a map of the runway. The aircraft indicia show the current position of the aircraft on the runway. In at least one embodiment, the display also shows suitable exit indicia on the map of the runway. The display may also show non-suitable exit indicia on the map of the runway.

Certain embodiments of the present disclosure provide a runway exiting method that is configured to determine a suitable exit off of a runway for an aircraft. The runway exiting method includes determining a current position of the aircraft on the runway, determining a current rate of deceleration of the aircraft on the runway, and determining the suitable exit off of the runway for the aircraft based, at least in part, on the current position of the aircraft on the runway and the current rate of deceleration of the aircraft on the runway.

Certain embodiments of the present disclosure provide an aircraft that includes a fuselage having wings and an empennage extending therefrom, a propulsion system carried by one or both of the wings or the empennage, a cockpit within the fuselage, and a runway exiting system within the cockpit. The runway exiting system is configured to determine a suitable exit off of a runway for the aircraft.

DETAILED DESCRIPTION OF THE DISCLOSURE

The foregoing summary, as well as the following detailed description of certain embodiments will be better understood when read in conjunction with the appended drawings. As used herein, an element or step recited in the singular and preceded by the word "a" or "an" should be understood as not necessarily excluding the plural of the elements or steps. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

Certain embodiments of the present disclosure provide systems and methods that allow a pilot to plan for exiting off a runway by providing updated information on an aircraft stopping location. After the aircraft touches down on a runway, the pilot applies the brakes, and a position signal (such as a global position system (GPS) signal) is used to determine a location of the aircraft on the runway. A deceleration rate is determined, such as through a comparison of position signals over a predetermined period of time. Based on a rate of deceleration of the aircraft, a suitable exit point from the runway onto a taxiway is determined. The position of the aircraft and the deceleration rate may be continually analyzed in order to update a location of a suitable exit point. The exit positions are shown on a display, which correlates the aircraft position with a map of the runway, for example. Embodiments of the present disclosure provide systems and methods that minimize or otherwise reduce a time that aircraft spends on a runway (thereby clearing the runway sooner), which, in turn increases airport throughput and efficiency.

Figure 1:
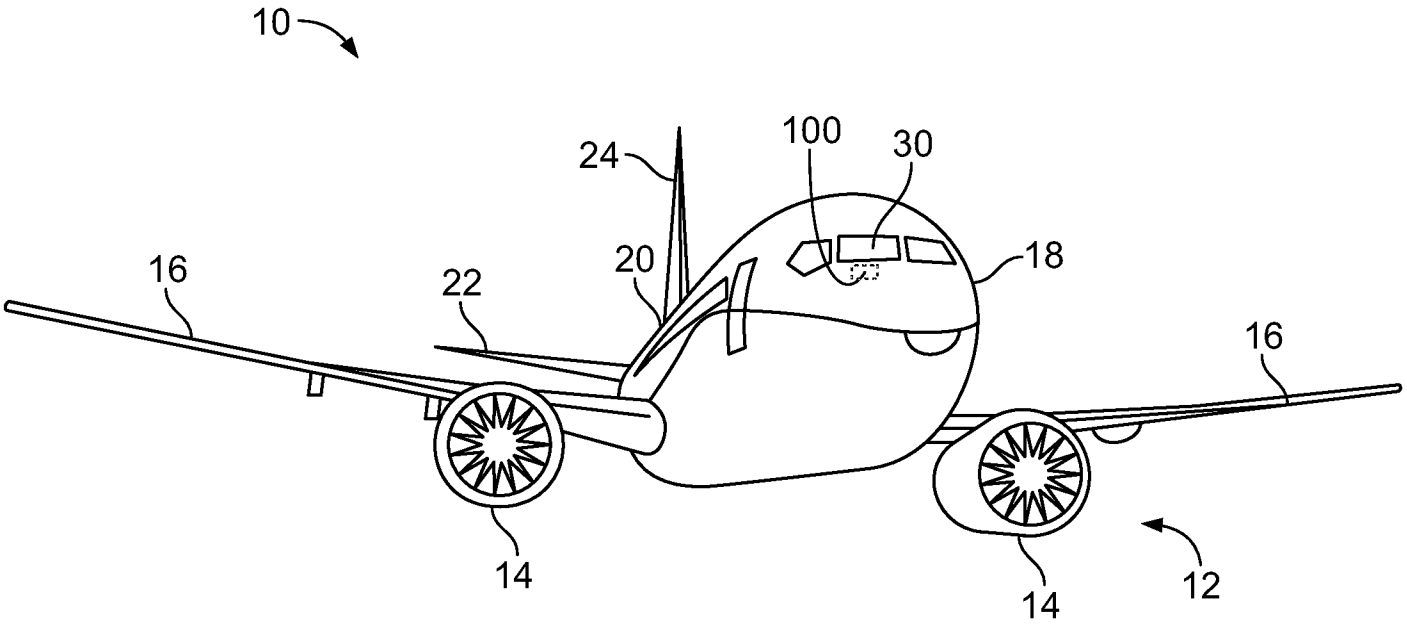
FIG. 1 is a diagrammatic representation of a front perspective view of an aircraft, according to an embodiment of the present disclosure.

FIG. 1 is a diagrammatic representation of a front perspective view of an aircraft 10 (or aircraft assembly), according to an embodiment of the present disclosure. The aircraft 10 includes a propulsion system 12 that may include two turbofan engines 14, for example. Optionally, the propulsion system 12 may include more engines 14 than shown. The engines 14 are carried by wings 16 of the aircraft 10. In other embodiments, the engines 14 may be carried by a fuselage 18 and/or an empennage 20. The empennage 20 may also support horizontal stabilizers 22 and a vertical stabilizer 24.

The fuselage 18 of the aircraft 10 defines an interior cabin, which includes a cockpit 30, one or more work sections (for example, galleys, personnel carry-on baggage areas, and the like), one or more passenger sections (for example, first class, business class, and coach sections), and an aft section. Each of the sections may be separated by a cabin transition area, which may include one or more class divider assemblies. A runway exiting system 100 is disposed within the cockpit 30.

Figure 2:
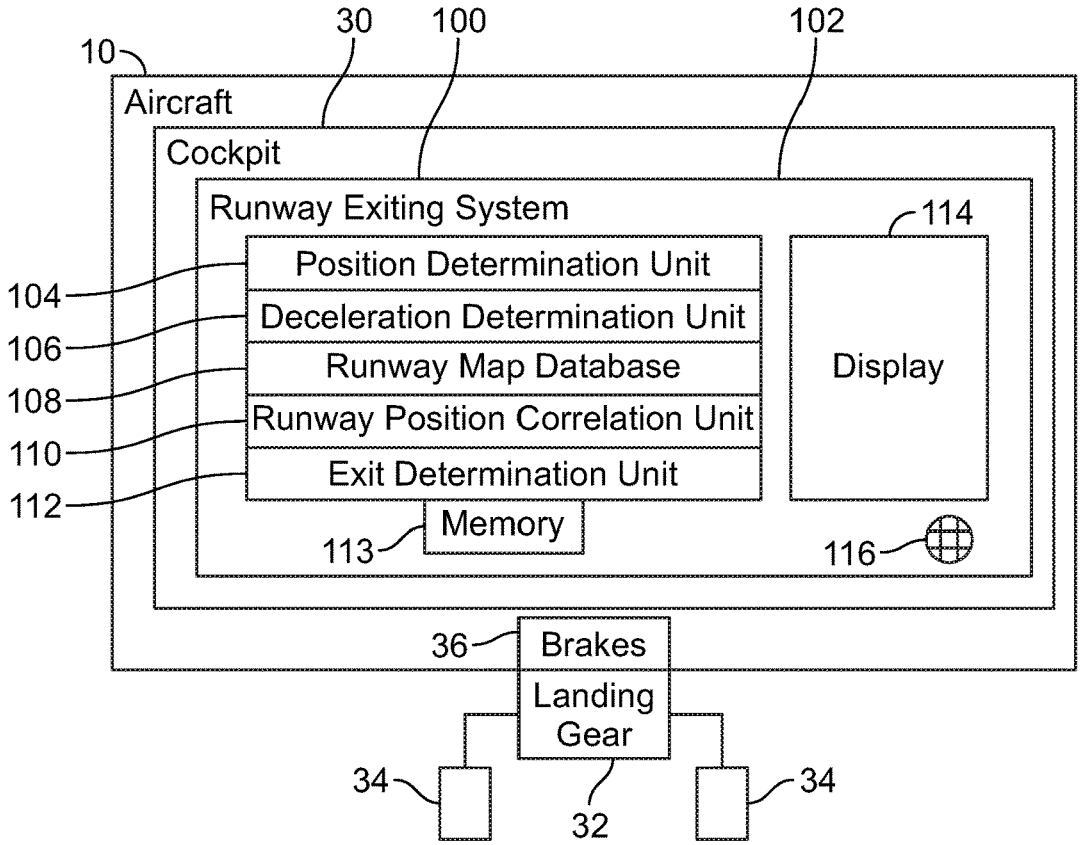
FIG. 2 is a schematic block diagram representation of a runway exiting system within a cockpit of an aircraft, according to an embodiment of the present disclosure.

FIG. 2 is a schematic block diagram representation of the runway exiting system 100 within the cockpit 30 of the aircraft 10, according to an embodiment of the present disclosure. The aircraft 10 further includes landing gear 32 having deployable wheels 34 and brakes 36 operatively coupled to the wheels 34. A pilot of the aircraft applies the brakes 36 to slow rotation of the wheels 34, for example, in order to decelerate and stop the aircraft 10 on the ground.

The runway exiting system 100 includes a housing 102 that contains a position determination unit 104, a deceleration determination unit 106, a runway map database 108, a runway position correlation unit 110, and an exit determination unit 112. A display 114 is also coupled to the housing 102.

In at least one embodiment, the runway exiting system 100 is part of a handheld device, such as an electronic smart tablet, smart phone, and/or the like. As such, the housing 102 may be configured to be held by a pilot. In at least one other embodiment, the runway exiting system 100 is a fixed system onboard the aircraft 10, such as part of a flight computer of the aircraft 10.

The position determination unit 104, the deceleration determination unit 106, the runway position correlation unit 110, and the exit determination unit 112 are in communication with each other. In at least one embodiment, each of the units 104, 106, 110, and 112 are separate and distinct processors that are in communication with one another, such as through one or more wired or wireless connections. In at least one other embodiment, each of the units 104, 106, 110, and 112 forms part of a single processor.

As shown, the runway map database 108 is contained within the housing 102 of the runway exiting system 100. In at least one other embodiment, the runway map database 108 is remotely located from the housing 102, and is in communication with the runway exiting system 100 through one or more wired or wireless connections. For example, the runway map database 108 may be within a control tower of an airport. In such an embodiment, runway exiting system 100 may be communicatively coupled to the runway map database 108 through a communication device, such as an antenna, transceiver, wireless connections, and/or the like of the runway exiting system 100.

The display 114 may include a monitor, screen (for example, a touchscreen), lights (for example, light emitting diodes), or the like that is configured to show data, graphics, videos, and/or the like to a pilot within the cockpit 30. For example, the display 114 may be a touchscreen of a smart tablet or a smart phone.

The position determination unit 104 is configured to determine a position of the aircraft 10. For example, the position determination unit 104 may be a GPS system that outputs a current position of the aircraft 10 with respect to the Earth.

The deceleration determination unit 106 is configured to determine a deceleration rate of the aircraft 10 on land. For example, the deceleration determination unit 106 compares subsequent positions of the aircraft 10 (output by the position determination unit 104) and determines a deceleration rate of the aircraft 10. For example, the deceleration determination unit 106 may compare one or more position signals output by the position determination unit 104 over a predetermined period of time. For example, the deceleration determination unit 106 may compare a first position signal output by the position determination unit 104 with a second position signal output by the position determination unit 104 one second after the first position signal to determine the deceleration rate of the aircraft 10. Optionally, the period of time between compared position signals may be greater or less than once second. For example, the period of time between compared position signals may be two or more seconds, or a half second or less. The deceleration determination unit 106 determines the deceleration rate of the aircraft 10 based on the change of position of the aircraft 10 between the first position signal and the second position signal, for example, over time. In at least one other embodiment, the deceleration rate may be determined based, at least in part, on pressure applied to the wheels 34 via the brakes 36. That is, braking effort may be used to determine the deceleration rate.

The runway map database 108 stores one or more digital runway maps of one or more airports. The runway maps include taxiways and exits connected to the runways. A runway exit is a type of taxiway that connects to a runway.

The runway position correlation unit 110 correlates a current position of the aircraft 10 on a particular digital runway map (that is indicative of a particular runway) stored in the runway map database 108. The runway position correlation unit 110 is communicatively coupled to the display 114 (such as through one or more wired or wireless connections) and overlays an indicia of the aircraft on a representation of the runway (for example, the digital runway map), which is shown on the display 114.

The exit determination unit 112 is configured to determine a suitable exit from the runway. For example, the exit determination unit 112 receives the position signal from the position determination to determine a current position of the aircraft 10. The exit determination unit 112 receives a deceleration signal output by the deceleration determination unit to determine a current deceleration rate of the aircraft. The exit determination unit 112 may include or be otherwise communicatively coupled to a memory 113, which stores rules for determining a suitable safe exit from a runway based on the locations of the exits from a current position of the aircraft 10, the deceleration rate of the aircraft 10, turning capability of the aircraft 10 while on the ground, and/or the like.

In operation, as the aircraft 10 touches down on a runway, the pilot applies the brakes 36 to decelerate the aircraft 10. The position determination unit 104 outputs a position signal that indicates a current position of the aircraft 10. The deceleration determination unit 106 compares the position signal of the aircraft 10 over time to determine the deceleration rate of the aircraft 10. The runway position correlation unit 110 correlates the current position of the aircraft 10 with respect to a representation of the runway, as accessed from the runway map database 108. The runway position correlation unit 110 outputs an aircraft display signal to the display 114, which shows the current position of the aircraft on the runway map.

The exit determination unit 112 determines a suitable taxiway for the aircraft to exit from the runway based on the current position of the aircraft 10 (as indicated by the position signals output by the position determination unit 104 and received by the exit determination unit 112), the deceleration rate of the aircraft 10 (as determined by a deceleration rate signal output by the deceleration determination unit 106 and received by the exit determination unit 112), and the location of the exits of the runway (as determined from the runway map stored in the runway map database 108). The exit determination unit 112 is communicatively coupled to the display 114 (such as through one or more wired or wireless connections) and indicates the suitable exit on the displayed runway map, such as through graphics, text, color coding, and/or the like.

In at least one embodiment, the runway exiting system 100 may include a speaker 116. The exit determination unit 112 may output an audio signal through the speaker 116 that indicates a suitable exit.

As used herein, the term "unit," "control unit," "central processing unit," "CPU," "computer," or the like may include any processor-based or microprocessor-based system including systems using microcontrollers, reduced instruction set computers (RISC), application specific integrated circuits (ASICs), logic circuits, and any other circuit or processor including hardware, software, or a combination thereof capable of executing the functions described herein. Such are exemplary only, and are thus not intended to limit in any way the definition and/or meaning of such terms. For example, each of the units 104, 106, 110, and 112 may be, include, or be part of one or more processors that are configured to control operations, as described above.

Each of the units 104, 106, 110, and 112 is configured to execute a set of instructions that are stored in one or more data storage units or elements (such as one or more memories), in order to process data. For example, each of the units 104, 106, 110, and 112 may include or be coupled to one or more memories. The data storage units may also store data or other information as desired or needed. The data storage units may be in the form of an information source or a physical memory element within a processing machine.

The set of instructions may include various commands that instruct each of the units 104, 106, 110, and 112 as a processing machine to perform specific operations such as the methods and processes of the various examples of the subject matter described herein. The set of instructions may be in the form of a software program. The software may be in various forms such as system software or application software. Further, the software may be in the form of a collection of separate programs, a program subset within a larger program, or a portion of a program. The software may also include modular programming in the form of object-oriented programming. The processing of input data by the processing machine may be in response to user commands, or in response to results of previous processing, or in response to a request made by another processing machine.

The diagrams of examples herein may illustrate one or more control or processing units, such as the units 104, 106, 110, and 112. It is to be understood that the processing or control units may represent circuits, circuitry, or portions thereof that may be implemented as hardware with associated instructions (e.g., software stored on a tangible and non-transitory computer readable storage medium, such as a computer hard drive, ROM, RAM, or the like) that perform the operations described herein. The hardware may include state machine circuitry hardwired to perform the functions described herein. Optionally, the hardware may include electronic circuits that include and/or are connected to one or more logic-based devices, such as microprocessors, processors, controllers, or the like. Optionally, each of the units 104, 106, 110, and 112 may represent processing circuitry such as one or more of a field programmable gate array (FPGA), application specific integrated circuit (ASIC), microprocessor(s), and/or the like. The circuits in various examples may be configured to execute one or more algorithms to perform functions described herein. The one or more algorithms may include aspects of examples disclosed herein, whether or not expressly identified in a flowchart or a method.

As used herein, the terms "software" and "firmware" are interchangeable, and include any computer program stored in a data storage unit (for example, one or more memories) for execution by a computer, including RAM memory, ROM memory, EPROM memory, EEPROM memory, and non-volatile RAM (NVRAM) memory. The above data storage unit types are exemplary only, and are thus not limiting as to the types of memory usable for storage of a computer program.

Figure 3:
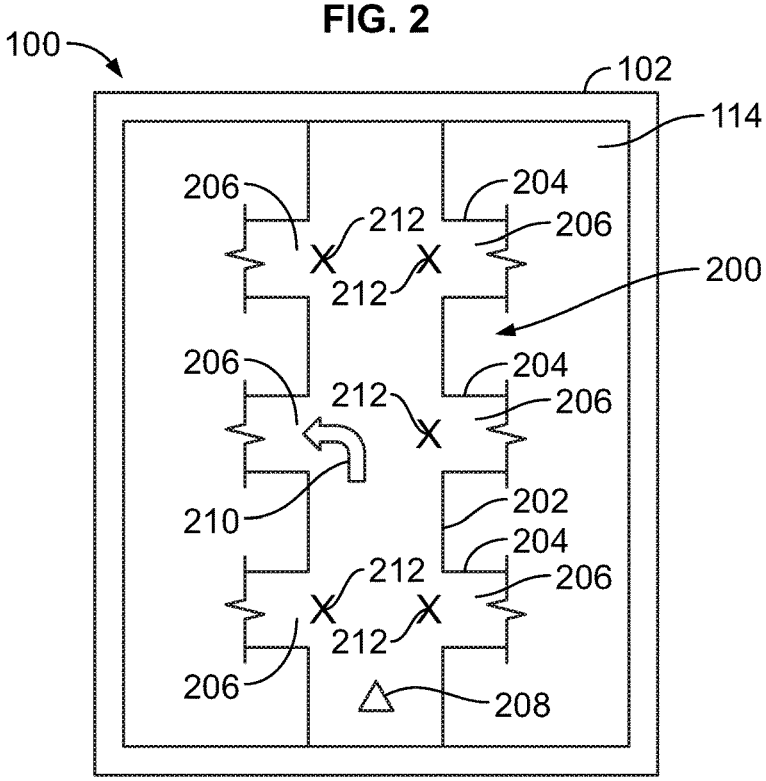
FIG. 3 is a diagrammatic representation of a front view of a runway exiting system, according to an embodiment of the present disclosure.

FIG. 3 is a diagrammatic representation of a front view of the runway exiting system 100, according to an embodiment of the present disclosure. Referring to FIGS. 2 and 3, the display 114 shows a representation of a digital map 200 of a runway 202, including taxiways 204, and exits 206 from the runway 202 onto the taxiways 204.

A current position of the aircraft 10, as determined by the position determination unit 104, is superimposed on the map 200 and shown by aircraft indicia 208. The aircraft indicia 208 may be a shape (such as a triangle, block, circle, plane-shape, or the like) that is shown on the digital map 200.

The exit determination unit 112 determines a suitable exit for the aircraft 10 to exit from runway 202 onto a particular taxiway 204 based on the current position and current deceleration rate of the aircraft 10. The exit determination unit 112 then indicates the suitable exit through exit indicia 210, such as a turn graphic. Optionally, the exit indicia 210 may be text, such as "TURN HERE." As another option, the exit indicia 210 may be a color coding, such as an illumination of the suitable exit in a particular color (such as green). In at least one embodiment, the exit indicia 210 includes two or more of the turn graphic, text, color coding, and/or the like.

The exit determination unit 112 may also indicate non-suitable exits on the digital map 200 with non-suitable indicia 212. The non-suitable indicia 212 may be or include a stop sign, an X, text (such as "DO NOT TURN HERE"), color coding that is in contrast to color coding for a suitable exit (for example, illumination of a non-suitable exit as red), and/or the like. Non-suitable exits include unsafe exits (such as those that are too close to a fast moving aircraft 10 based on a particular deceleration rate and/or speed of the aircraft 10) and remote exits (such as those that are farther away from a suitable exit). Optionally, the exit determination unit 112 may not expressly indicate non-suitable indicia on the map 200. The exit determination unit 112 may continually update a location of a suitable exit, such as if the aircraft 10 bypasses a previously-determined suitable exit, and/or if the deceleration rate of the aircraft changes.

Figure 4:
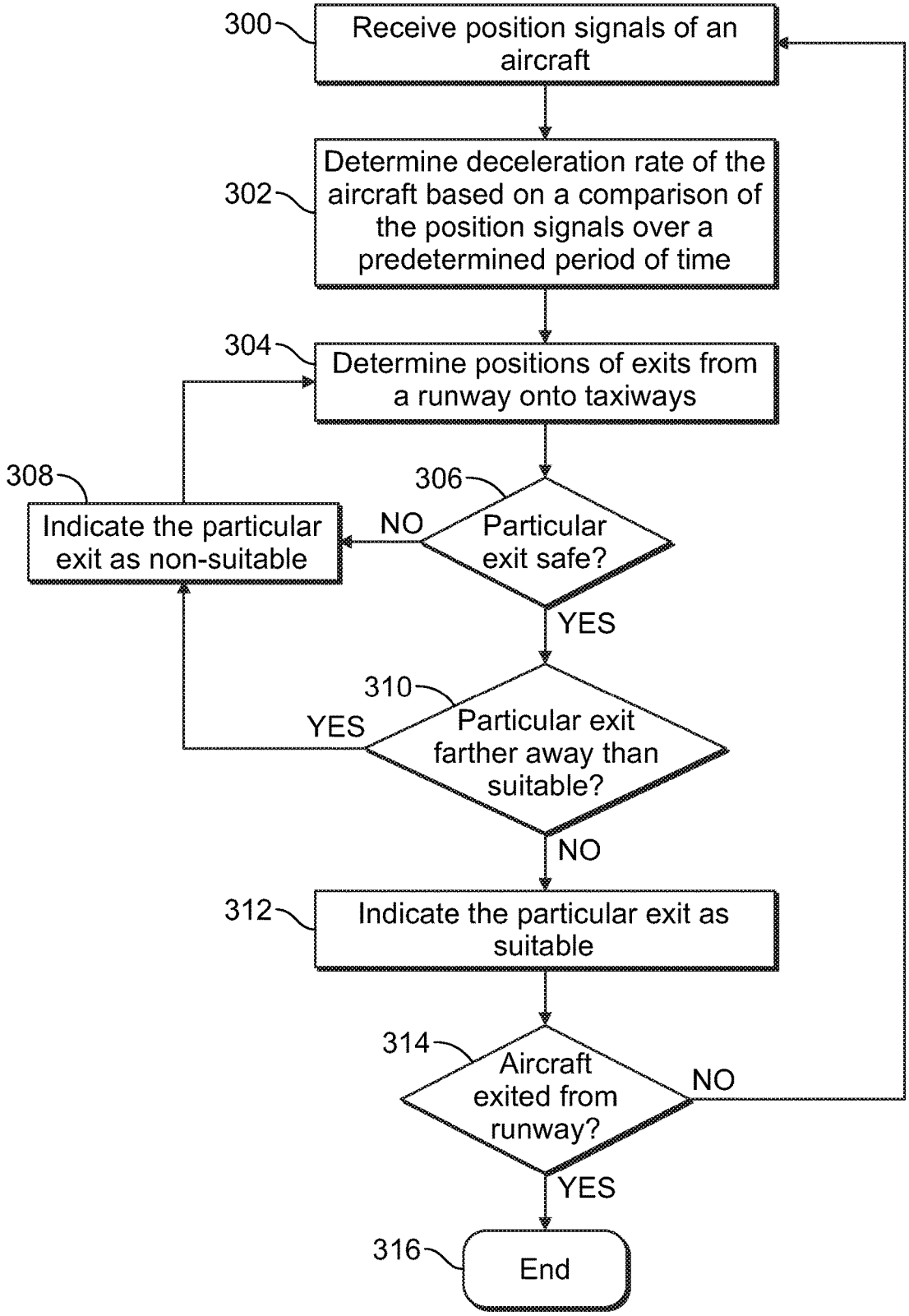
FIG. 4 illustrates a flow chart of a method of determining a suitable exit from a runway for an aircraft, according to an embodiment of the present disclosure.

FIG. 4 illustrates a flow chart of a method of determining a suitable exit from a runway for an aircraft 10, according to an embodiment of the present disclosure. Referring to FIGS. 2-4, the method beings at 300, at which the deceleration determination unit 106 receives position signals (indicative of a position of the aircraft 10) output by the position determination unit 104. At 302, the deceleration determination unit determines a deceleration rate of the aircraft 10 based on a comparison of the position signals over a predetermined period of time.

At 304, the exit determination unit 112 determines positions of exits onto taxiways from a runway, based on runway map data stored in the runway map database 108. At 306, the exit determination unit 112 determines whether a particular exit is safe based on a current position and current deceleration rate of the aircraft 10 on the runway. If the exit is not safe, the exit determination unit 112 indicates the exit as non-suitable on the digital map 200 shown on the display 114 at 308. The method then returns to 304.

If, however, the exit determination unit 112 determines that the particular exit is safe at 306, the method proceeds to 310, at which the exit determination unit 112 determines whether the particular exit is farther away than suitable (based on a current position and current deceleration rate of the aircraft 10). If the particular exit is farther away than suitable, the exit determination unit 112 indicates the particular exit as non-suitable at 308, and the method returns to 304. If, however, the exit determination unit 112 determines at 310 that the particular exit is not farther away than suitable, the method proceeds to 312, at which the exit determination unit indicates that particular exit as suitable on the map 200 shown on the display 114.

At 314, it is then determined (such as by the exit determination unit 112) if the aircraft 10 has exited from the runway. If the aircraft 10 is still on the runway, the method returns to 300. If, however, the aircraft 10 has exited from the runway, the method ends at 316.

As described above, embodiments of the present disclosure provide systems and methods for efficiently and safely directing pilots to exit a runway. Embodiments of the present disclosure reduce flight arrival and departure times at an airport. Embodiments of the present disclosure improve flight turnaround at an airport.

The runway exiting systems and methods described above allow a pilot to safely and efficiently maneuver an aircraft off of a runway, which reduces the time it takes for the aircraft to arrive at a gate, and depart on a subsequent flight from the gate. As such, flight turnaround time may be reduced, which may lead to greater customer satisfaction, and may allow an increased number of flights per day (thereby potentially increasing revenue for aircraft operator(s)). Reduced flight turnaround times also improves an aircraft operator's reputation. For example, an aircraft operator that is consistently on time will be favored by consumers.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §

112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal language of the claims.

What is claimed is:

1. A runway exiting system that is configured to determine a suitable exit off of a runway for an aircraft, the runway exiting system comprising:

a housing; and one or more processors within the housing that are configured to determine a current position of the aircraft on the runway, determine a current rate of deceleration of the aircraft on the runway based, at least in part, on changed positions of the aircraft on the runway over time, determine the suitable exit off of the runway for the aircraft based, at least in part, on the current position of the aircraft on the runway and the current rate of deceleration of the aircraft on the runway, and determine non-suitable exits off of the runway based, at least in part, on the current position of the aircraft on the runway and the current rate of deceleration of the aircraft on the runway, wherein the non-suitable exits include unsafe exits that are too close to the current position of the aircraft on the runway and remote exits of the runway that are past the suitable exit.

2. The runway exiting system of claim 1, wherein the one or more processors comprises a position determination unit that is configured to determine the current position of the aircraft and output one or more position signals indicative of the current position of the aircraft.

3. The runway exiting system of claim 2, wherein the one or more processors comprises a deceleration determination unit that is configured to determine the current deceleration rate of the aircraft by analyzing the one or more position signals over a predetermined period of time.

4. The runway exiting system of claim 1, further comprising a runway map database that stores a digital map of the runway.

5. The runway exiting system of claim 4, wherein the runway map database is contained within the housing.

6. The runway exiting system of claim 1, wherein the one or more processors comprises a runway position correlation unit that is configured to correlate a current position of the aircraft with respect to a digital map that is indicative of the runway.

7. The runway exiting system of claim 1, wherein the one or more processors comprises an exit determination unit that is configured to determine the suitable exit off of the runway for the aircraft based, at least in part, on the current position of the aircraft on the runway and the current rate of deceleration of the aircraft on the runway.

8. The runway exiting system of claim 1, further comprising a display coupled to the housing, wherein the display is configured to show aircraft indicia superimposed on a digital map of the runway, wherein the aircraft indicia shows the current position of the aircraft on the runway.

9. The runway exiting system of claim 8, wherein the display is configured to show suitable exit indicia on the map of the runway.

10. The runway exiting system of claim 9, wherein the display is configured to show non-suitable exit indicia on the map of the runway.

11. A runway exiting method that is configured to determine a suitable exit off of a runway for an aircraft, the runway exiting method comprising:

determining a current position of the aircraft on the runway;

determining a current rate of deceleration of the aircraft on the runway;

determining the suitable exit off of the runway for the aircraft based, at least in part, on the current position of the aircraft on the runway and the current rate of deceleration of the aircraft on the runway; and determining non-suitable exits off of the runway based, at least in part, on the current position of the aircraft on the runway and the current rate of deceleration of the aircraft on the runway, wherein the non-suitable exits include unsafe exits that are too close to the current position of the aircraft on the runway and remote exits of the runway that are past the suitable exit.

12. The runway exiting method of claim 11, wherein the determining the current position comprises using a position determination unit to determine the current position of the aircraft and output one or more position signals indicative of the current position of the aircraft.

13. The runway exiting method of claim 12, wherein the determining the current rate of deceleration comprises using a deceleration determination unit to determine the current deceleration rate of the aircraft by analyzing the one or more position signals over a predetermined period of time.

14. The runway exiting method of claim 11, further comprising storing a digital map of the runway within a runway map database.

15. The runway exiting method of claim 14, further comprising containing the runway map database within a handheld housing.

16. The runway exiting method of claim 11, wherein the determining the suitable exit comprises using a runway position correlation unit to correlate a current position of the aircraft with respect to a digital map that is indicative of the runway.

17. The runway exiting method of claim 11, wherein the determining the suitable exit comprises using an exit determination unit to determine the suitable exit off of the runway for the aircraft based, at least in part, on the current position of the aircraft on the runway and the current rate of deceleration of the aircraft on the runway.

18. The runway exiting method of claim 11, further comprising displaying aircraft indicia superimposed on a map of the runway, wherein the aircraft indicia shows the current position of the aircraft on the runway.

19. The runway exiting method of claim 18, further comprising:

displaying suitable exit indicia on the map of the runway; and displaying non-suitable exit indicia on the map of the runway.

20. An aircraft comprising:

a fuselage having wings and an empennage extending therefrom;

a propulsion system carried by one or both of the wings or the empennage;

a cockpit within the fuselage; and a runway exiting system within the cockpit, the runway exiting system being configured to determine a suitable exit off of a runway for the aircraft, the runway exiting system comprising:

a housing; and a position determination unit within the housing, wherein the position determination unit is configured to determine a current position of the aircraft and output one or more position signals indicative of the current position of the aircraft;

a deceleration determination unit within the housing, wherein the deceleration determination unit is configured to determine a current deceleration rate of the aircraft by analyzing the one or more position signals over a predetermined period of time;

a runway map database that stores a digital map of the runway;

a runway position correlation unit within the housing, wherein the runway position correlation unit is configured to correlate the current position of the aircraft with respect to the digital map of the runway;

an exit determination unit within the housing, wherein the exit determination unit is configured to determine the suitable exit off of the runway for the aircraft based, at least in part, on the current position of the aircraft on the runway and the current rate of deceleration of the aircraft on the runway and determine non-suitable exits off of the runway based, at least in part, on the current position of the aircraft on the runway and the current rate of deceleration of the aircraft on the runway, wherein the non-suitable exits include unsafe exits that are too close to the current position of the aircraft on the runway and remote exits of the runway that are past the suitable exit; and a display coupled to the housing, wherein the display is configured to show: (a) aircraft indicia superimposed on the digital map of the runway, wherein the aircraft indicia shows the current position of the aircraft on the runway, (b) suitable exit indicia on the digital map of the runway, and (c) non-suitable exit indicia on the digital map of the runway.

* * * * *